US008715565B2

(12) United States Patent
Sugiyama et al.

(10) Patent No.: US 8,715,565 B2
(45) Date of Patent: May 6, 2014

(54) COOLING SYSTEM AND COOLING METHOD OF ROLLING STEEL

(75) Inventors: Seiji Sugiyama, Tokyo (JP); Tatsuya Yamanokuchi, Tokyo (JP); Takeshi Kimura, Tokyo (JP); Mitsugu Kajiwara, Tokyo (JP); Kazuhisa Fujiwara, Tokyo (JP); Takuya Sato, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 516 days.

(21) Appl. No.: 12/867,706

(22) PCT Filed: Feb. 25, 2009

(86) PCT No.: PCT/JP2009/053377

§ 371 (c)(1), (2), (4) Date: Aug. 13, 2010

(87) PCT Pub. No.: WO2009/107639

PCT Pub. Date: Sep. 3, 2009

(65) Prior Publication Data

US 2010/0307646 A1 Dec. 9, 2010

(30) Foreign Application Priority Data

Feb. 27, 2008 (JP) ..... P2008-046461
Feb. 28, 2008 (JP) ..... P2008-048383

(51) Int. Cl.
*C21D 1/62* (2006.01)

(52) U.S. Cl.
USPC ..... 266/113; 266/46; 266/114; 148/638

(58) Field of Classification Search
USPC ..... 266/114, 134, 46, 44, 113; 148/582, 148/574, 581, 637–639, 661; 239/557, 556, 239/549, 550, 552, 434
See application file for complete search history.

(56) References Cited

U.S. PATENT DOCUMENTS 4,541,473 A * 9/1985 Onoe et al. ..... 164/444
(Continued)

FOREIGN PATENT DOCUMENTS

GB 1 370 144 10/1974
(Continued)

OTHER PUBLICATIONS

Machine translation of JP 08-319515, 1996.*
(Continued)

*Primary Examiner* — Scott Kastler
*Assistant Examiner* — Michael Aboagye
(74) *Attorney, Agent, or Firm* — Birch, Stewart, Kolasch & Birch, LLP

(57) ABSTRACT

A cooling system that cools hot rolled long steel bar, provided with a plurality of chambers that are arranged along the longitudinal direction of the rolled steel bar. Each of the plurality of chambers is provided with a blow outlet that, facing from the chamber to the rolled steel bar, blows out compressed air for cooling that is introduced to the chamber from a gas inlet that is connected to the chamber; a nozzle plate having a plurality of nozzle holes that is provided at this blow outlet so as to face the rolled steel bar; a cooling water supply nozzle that supplies cooling water into the chamber; and a rectifying plate that is provided between the gas inlet and the cooling water supply nozzle, and that prevents the compressed gas for cooling that is introduced from the gas inlet from directly striking the nozzle plate. The cooling system of the present invention sprays a cooling medium that is produced by mixing the cooling water that is supplied from the cooling water supply nozzle and the compressed gas for cooling that is introduced from the gas inlet and rectified by the rectifying plate toward the rolled steel bar through the nozzle holes of the nozzle plate, and performs uniform cooling of the surfaces of the rolled steel bar.

17 Claims, 7 Drawing Sheets

(56) References Cited

U.S. PATENT DOCUMENTS

| | | | | |
|---|---|---|---|---|
| 4,660,619 | A * | 4/1987 | Nettelbeck et al. | 164/455 |
| 4,950,338 | A * | 8/1990 | Kotsch et al. | 148/581 |
| 5,004,510 | A * | 4/1991 | Yu et al. | 148/569 |
| 6,689,230 | B1 * | 2/2004 | Meyer et al. | 148/508 |

FOREIGN PATENT DOCUMENTS

| | | | |
|---|---|---|---|
| JP | 47-7606 | | 4/1972 |
| JP | 54-147124 | A | 11/1979 |
| JP | 57-85929 | A | 5/1982 |
| JP | 61-149436 | A | 7/1986 |
| JP | 61-279626 | A | 12/1986 |
| JP | 8-144016 | A | 6/1996 |
| JP | 8-170120 | A | 7/1996 |
| JP | 8-319514 | A | 12/1996 |
| JP | 8-319515 | A | 12/1996 |
| JP | 9-137228 | A | 5/1997 |
| JP | 2000-26916 | A | 1/2000 |
| JP | 2006-110611 | A | 4/2006 |
| RU | 2 336 336 | C2 | 10/2008 |
| SU | 1066688 | A | 1/1984 |

OTHER PUBLICATIONS

Machine translation of JP 2000-026916, 2000.*

International Search Report—dated Apr. 21, 2009 for PCT/JP2009/053377.

Office Action issued on the counterpart Japanese Patent Application No. 2008-046461.

Decison on Grant (Notice of Allowance) mailed Dec. 7, 2011, issued in Russian Patent Application No. 2010136833/02(052297) (English translation attached).

* cited by examiner

●: NOZZLE INDIVIDUAL DROPLET FLOW RATE PROPORTION

○: MIST DROPLET FLOW RATE PROPORTION FROM NOZZLE PLATE

△: AIR DISCHARGE PRESSURE PROPORTION FROM NOZZLE PLATE

IN THE CASE OF EACH OF ● ○ △ , THE PROPORTIONS ARE CALCULATED WITH THE VALUE AT THE CENTER OF THE COOLING APPARATUS SERVING AS A REFERENCE

●: NOZZLE INDIVIDUAL DROPLET FLOW RATE PROPORTION

○: MIST DROPLET FLOW RATE PROPORTION FROM NOZZLE PLATE

△: AIR DISCHARGE PRESSURE PROPORTION FROM NOZZLE PLATE

IN THE CASE OF EACH OF ● ○ △ , THE PROPORTIONS ARE CALCULATED WITH THE VALUE AT THE CENTER OF THE COOLING APPARATUS SERVING AS A REFERENCE

COOLING SYSTEM AND COOLING METHOD OF ROLLING STEEL

TECHNICAL FIELD

The present invention relates to a cooling system and a cooling method for cooling long rolled steel bar such as a hot-rolled rail.

Priority is claimed on Japanese Patent Application No. 2008-046461, filed Feb. 27, 2008, and Japanese Patent Application No. 2008-048383, filed Feb. 28, 2008, the contents of which are incorporated herein by reference.

BACKGROUND ART

Railroad rails that are used for heavy load railroads and curved sections are required to have more abrasion resistance than ordinary rails. For this reason, after undergoing hot rolling, during the time from the austenite region temperature until the end of the pearlite transformation, a process is performed to raise the strength of the rail head portion by accelerated cooling. In recent years, in order to further improve the abrasion resistance, a pearlitic rail has been developed and put to practical use in which the carbon content is increased until the hypereutectoid region (Refer to Patent Document 1).

However, when the carbon content is increased in order to improve abrasion resistance, problems such as proeutectoid cementite readily forming in the rail head portion, and the toughness and ductility of the rail dropping sharply occur.

Therefore, Patent Document 2 discloses a pearlite rail manufacturing method in which, in order to suppress the formation of proeutectoid cementite in the pillar portion of a rail, and stably generate a pearlite microstructure with a high degree of hardness and a high cementite ratio in the railhead, a railhead is subjected to accelerated cooling from the austenitic region temperature to 700 to 500° C. at a rate of 1 to 10° C./second, and moreover the pillar of this rail is subjected to accelerated cooling from the austenitic region temperature to 750 to 600° C. at a rate of 1 to 10° C./second.

In addition, as accelerated cooling methods for a rail employing different cooling mediums, there are (1) methods that use a mist (Patent Documents 3 to 5), methods that use a gas such as air (Patent Documents 6 and 7) and methods that immerse the railhead in a cooling liquid (Patent Documents 8 and 9).

[Patent Document 1] Japanese Unexamined Patent Application, First publication No. H08-144016

[Patent Document 2] Japanese Unexamined Patent Application, First publication No. H09-137228

[Patent Document 3] Japanese Unexamined Patent Application, First publication No. S47-7606 [Patent Document 4] Japanese Unexamined Patent Application, First publication No. S54-147124

[Patent Document 5] Japanese Unexamined Patent Application, First publication No. H08-319515

[Patent Document 6] Japanese Unexamined Patent Application, First publication No. S61-149436

[Patent Document 7] Japanese Unexamined Patent Application, First publication No. S61-279626

[Patent Document 8] Japanese Unexamined Patent Application, First publication No. S57-85929

[Patent Document 9] Japanese Unexamined Patent Application, First publication No. H08-170120

DISCLOSURE OF THE INVENTION

Problem that the Invention is to Solve

In order to produce a pearlite microstructure in high-carbon rail steel in a stable manner, it is necessary to make the cooling rate faster during accelerated cooling. However, in the case of attempting to realize this by the conventional accelerated cooling methods outlined above, the following issues have arisen.

When a droplet makes contact with a high-temperature body, the Leidenfrost phenomenon occurs in which a vapor film is formed between the droplet and the high-temperature body, and the droplet floats on the high-temperature body. In the case of using the methods of (1) and (3) that employ a liquid for the cooling medium, due to the vapor film that is formed on the rail surface, contact between the rail and the cooling medium is hindered, and so variations arise in the cooling rate. As a result, when a temperature deviation occurs in the rail and the temperature deviation becomes large, there is a risk that a deviation may also arise in the steel microstructure.

Moreover, the method of (2) which uses gas for the cooling medium has the drawback of the cooling rate being slower compared with a cooling method that employs a liquid.

The present invention was achieved in view of the above circumstances, and has as its object to provide a cooling system and cooling method for rolled steel bar that is capable of significantly raising the cooling rate by suppressing the formation of a vapor film on a long rolled steel bar and enables uniform accelerated cooling.

Means for Solving the Problem

In order to achieve the aforementioned object, the present invention is a cooling system that cools hot rolled long steel bar, provided with a plurality of chambers that are arranged along the longitudinal direction of the rolled steel bar. Each of the plurality of chambers is provided with a blow outlet that, facing from the chamber to the rolled steel bar, blows out compressed air for cooling that is introduced to the chamber from a gas inlet that is connected to the chamber; a nozzle plate having a plurality of nozzle holes that is provided at this blow outlet so as to face the rolled steel bar; a cooling water supply nozzle that supplies cooling water into the chamber; and a rectifying plate that is provided between the gas inlet and the cooling water supply nozzle, and that prevents the compressed gas for cooling that is introduced from the gas inlet from directly striking the nozzle plate. The cooling system of the present invention sprays a cooling medium that is produced by mixing the cooling water that is supplied from the cooling water supply nozzle and the compressed gas for cooling that is introduced from the gas inlet and rectified by the rectifying plate toward the rolled steel bar through the nozzle holes of the nozzle plate, and thereby the surfaces of the rolled steel bar is cooled uniformly.

When a liquid is used as a cooling medium, it is possible to ensure a large cooling capacity, but due to a vapor film that is formed on the surface of the rolled steel bar, variations occur in the cooling rate, and uneven cooling results. Therefore, in the present invention by installing the cooling water supply nozzle that supplies cooling water in the chamber that ejects compressed gas for cooling from the blow outlet toward the rolled steel bar, mixing the compressed gas for cooling with the cooling water, and spraying a mist in a perpendicular direction (preferably perpendicular) from the nozzle plate through the nozzle holes to the surface of the rolled steel bar, the impinging velocity of the waterdrops is increased, and the waterdrops adhering to the rolled steel bar are quickly removed. Thereby, the formation of a vapor film is impeded, and uniform cooling becomes possible without fluctuating the cooling rate.

Note that it is conceivable to use a high air-water ratio nozzle in which the ratio of the compressed gas for cooling to cooling water is raised, but when attempting to uniformly cool a long rolled steel bar in one action, many nozzles are required, and since nozzle maintenance frequently occurs, it is not realistic as industrialization equipment.

Regarding the compressed gas for cooling that is ejected from the nozzle plate through the nozzle holes, when viewing the discharge distribution in the lengthwise direction of the chamber, that is, the lengthwise direction of the rolled steel bar, the discharge amount is greatest in the vicinity of the gas inlet, and the discharge amount decreases as the distance from the gas inlet increases. In this state, in the case of supplying cooling water from the cooling water supply nozzle to the nozzle plate, the waterdrops are pushed by the compressed gas for cooling from behind in the vicinity of the gas inlet where the flow of the compressed gas for cooling is strong, and the water amount that is sprayed from the nozzle plate through the nozzle holes decreases. As a result, variations occur in the water amount throughout the chamber. Therefore, in the present invention, by installing a rectifying plate between the gas inlet and the cooling water supply nozzle, the compressed gas for cooling that is introduced from the gas inlet flows throughout the chamber via the rectifying plate, whereby variations in the water amount over the entire chamber are prevented.

Also, in the cooling system for rolled steel bar of the present invention, a plurality of holes may be formed in the rectifying plate.

In the case of forming the holes, it is preferable that the total area per unit area of the holes that are formed in locations facing the gas inlets is less than the total area per unit area of the holes that are formed in other locations, so that the discharge amount of the compressed gas for cooling that is ejected from the nozzle plate through the nozzle holes is uniform over the lengthwise direction of the chamber.

Also, in the cooling system for rolled steel bar of the present invention, it is preferable to make the cooling water supply nozzle oriented toward the nozzle plate.

The ratio of the volumetric flow of the compressed gas for cooling to the volumetric flow of the cooling water may be 1,000 to 50,000.

The ratio of the volumetric flow of the compressed gas for cooling to the volumetric flow of the cooling water is called the air-water ratio.

In the case of a high air-water ratio, since a vapor film that is formed on the surface of the rolled steel bar is removed by the compressed gas for cooling, the formation of the vapor film is inhibited, and stable cooling is ensured. At this time, when the air-water ratio is less than 1,000, variations in the cooling rate become large, and when the air-water ratio exceeds 50,000, the cooling effect is saturated.

The compressed gas for cooling may be air or nitrogen.

No consideration is given to the type of cooling medium in the present invention, but from the standpoint of handling and economy, it is preferably air or nitrogen.

The cooling water may be supplied from the cooling water supply nozzle in a mist state, a shower state, or a stream state.

The drop-size distribution of the mist that is sprayed from the nozzle plate through the nozzle holes was confirmed by testing conducted by the inventors to tend to be the same, regardless of the droplet diameter of the waterdrops that are supplied from the cooling water supply nozzle. As a reason for this, it is considered that the cooling water that is supplied into the chamber once coalesces at the nozzle plate, and the coalesced cooling water may be redispersed when sprayed from the holes in the nozzle plate together with the compressed air for cooling.

Accordingly, the cooling water to be supplied may be any one of a mist state, a shower state, or a stream state, and it is acceptable for only cooling water to be supplied from the cooling water supply nozzle, or for cooling water and compressed gas for cooling to be supplied in a blend. All that matters is that a predetermined quantity of water is supplied to above the nozzle plate.

The rolled steel bar is a rail, the chamber may be disposed so as to have a gap between the head top portion of the rail and the chamber, and the cooling medium may be sprayed from the nozzle holes of the nozzle plate toward the head top portion of the rail, and the chambers may be disposed so as to have a gap between the head side portions of the rail and the chambers, and the cooling medium may be sprayed from the nozzle holes of the nozzle plate toward the head side portions of the rail. By doing so, it is possible to spray a mist in a perpendicular direction to the surfaces of the rail head portion.

For each chamber, the chamber may be formed by a wide portion which is formed wide in order to provide the gas inlet, a narrow portion whose width is formed narrower than the wide portion, and a sloping portion that mutually couples the wide portion and the narrow portion, and the blow outlet may be provided at the end portion of the narrow portion.

The rolled steel bar is a rail, the chamber may be arranged above the rail, the rectifying plate is arranged in a horizontal state in the wide portion of the chamber, and a gap may be formed so that the compressed gas for cooling passes between the side edges of the rectifying plate and the inner walls of the wide portion.

In the cooling system for rolled steel bar of the present invention, in the case of the chamber being arranged on the sides of the rail, a chamber with the same constitution as the chamber that is arranged facing the head top portion of the rail is turned sideways (rotated 90°) and arranged on both sides of the rail.

The cooling method that cools hot rolled long steel bar of the present invention is a cooling method that cools long rolled steel bar that is hot rolled using a cooling system that is provided with a cooling water supply nozzle that supplies cooling water, a blow outlet that blows out a cooling medium that is produced by mixing compressed air for cooling that is introduced through a gas inlet and the cooling water, and a plurality of chambers each having a nozzle plate that is provided at the end portion of the blow outlet and that has a plurality of nozzle holes. The method includes rectifying the compressed air for cooling that is introduced to the chamber through the gas inlet with a rectifying plate that is disposed between the gas inlet and the cooling water supply nozzle, so that the compressed air for cooling that is introduced to the chamber does not directly head to the blow outlet; producing the cooling medium by mixing the compressed air for cooling that is rectified by the rectifying plate and the cooling water that is supplied from the cooling water supply nozzle; and spraying the cooling medium toward the surface of the rolled steel bar that is arranged along the blow outlet at a speed of 50 to 200 m/s through the plurality of nozzle holes of the nozzle plate, and uniformly cooling the entire length of the rolled steel bar.

As the impinging velocity increases, a higher cooling rate is obtained, and when the impinging velocity is 50 m/s or greater, variations in the cooling rate were judged as being reduced to around ±1.5° C. Note that when the impinging velocity exceeded 200 m/s, the cooling effect was saturated.

The ratio of the volumetric flow of the compressed gas for cooling to the volumetric flow of the cooling water may be 1,000 to 50,000.

The ratio of the volumetric flow of the compressed gas for cooling to the volumetric flow of the cooling water is called the air-water ratio.

In the case of a high air-water ratio, since a vapor film that is formed on the surface of the rolled steel bar is removed by the compressed gas for cooling, the formation of the vapor film is inhibited, and stable cooling is ensured. At this time, when the air-water ratio is less than 1,000, variations in the cooling rate become large, and when the air-water ratio exceeds 50,000, the cooling effect is saturated.

Also, in the cooling method for rolled steel bar of the present invention, it is preferable to make the cooling water supply nozzle oriented toward the nozzle plate.

The compressed gas for cooling may be air or nitrogen.

No consideration is given to the type of cooling medium in the present invention, but from the standpoint of handling and economy, it is preferably air or nitrogen.

The cooling water may be supplied from the cooling water supply nozzle in a mist state, a shower state, or a stream state.

The cooling start temperature of the rolled steel bar after hot rolling may be in the austenite region temperature or above, and the cooling end temperature of the rolled steel bar may be 450° C. to 600° C.

If the cooling start temperature is not in the austenite region temperature or above, and the cooling end temperature is not at least 600° C. or less, quenching does not occur, which is not preferred. On the other hand, when the accelerated cooling is continued until below 450° C., since a martensitic structure is produced in the rail head portion, although the hardness increases, since the toughness decreases, it is not preferred.

The rolled steel bar is a rail, and the chamber may be disposed so as to have a gap between a head top portion and head side portions of the rail and the chamber, and the cooling medium may be sprayed from the nozzle holes of the nozzle plate toward the head top portion and the head side portions of the rail. Thereby, it is possible to spray a mist in a perpendicular direction to the surfaces of the rail head portion.

Effect of the Invention

In the cooling system and cooling method for rolled steel bar of the present invention, by installing a cooling water supply nozzle that supplies cooling water in the chamber that ejects the compressed gas for cooling from the blow outlet toward the rolled steel bar, mixing the compressed gas for cooling and the cooling water, and spraying a mist in a perpendicular direction from the nozzle plate through the nozzle holes to the rolled steel bar, the impinging velocity of the waterdrops is increased, and the waterdrops adhering to the rolled steel bar are quickly removed. Thereby, the formation of a vapor film is impeded, and without fluctuating the cooling rate, uniform cooling becomes possible and stable accelerated cooling also becomes possible.

In addition, by installing the rectifying plate between the gas inlet and the cooling water supply nozzle, the compressed gas for cooling that is introduced from the gas inlet flows uniformly through the chamber via the rectifying plate, whereby it is possible to prevent variations in the droplet flow rate in the entire chamber.

Figure 1:
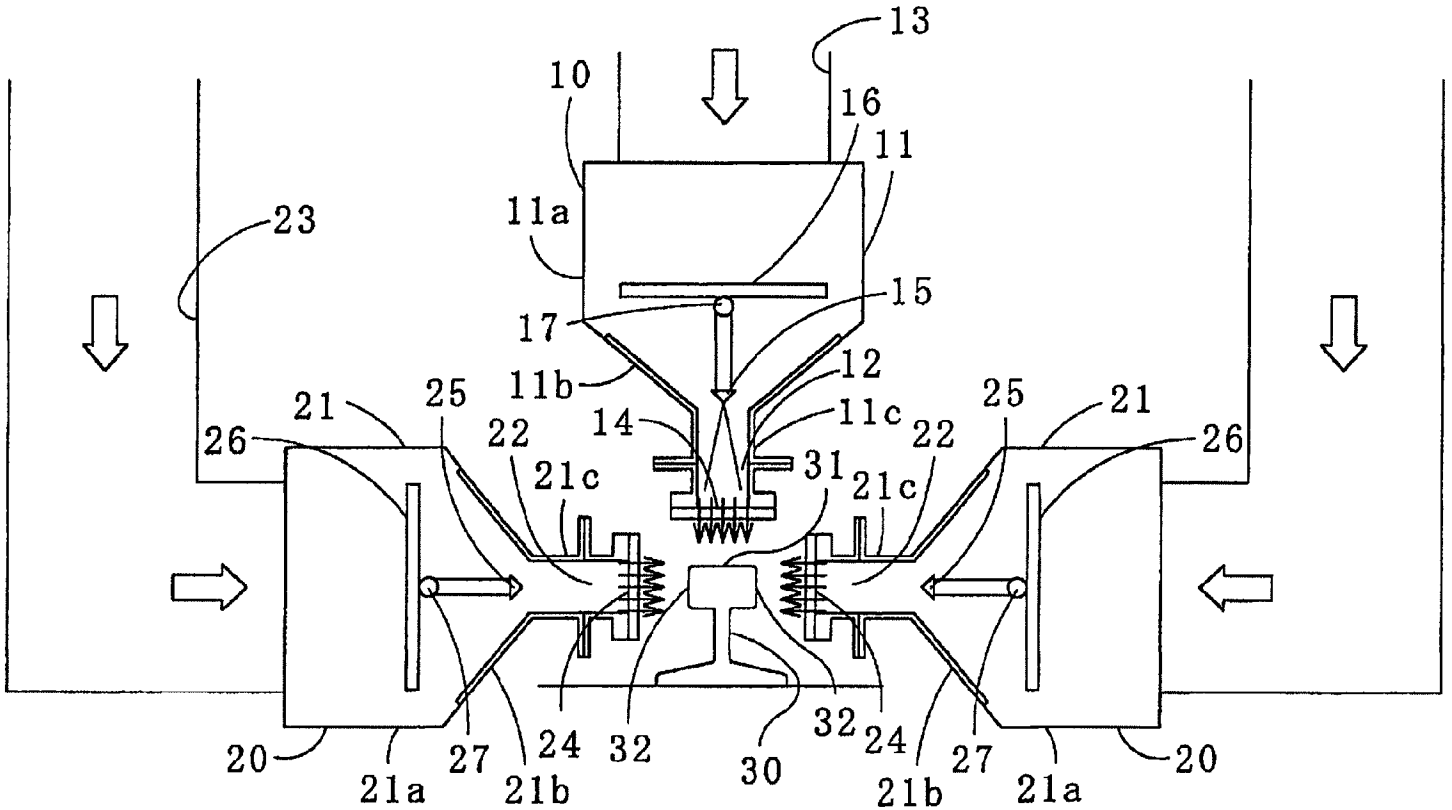
FIG. 1 is a schematic drawing that shows the cooling system for rolled steel bar of one embodiment of the present invention.

| DESCRIPTION OF REFERENCE NUMERALS | |
|---|---|
| 10 | cooling system |
| 11 | chamber |
| 11a | wide portion |
| 11b | sloping portion |
| 11c | narrow portion |
| 12 | blow outlet |
| 13 | gas inlet |
| 14 | nozzle plate |
| 14c | nozzle hole |
| 15 | cooling water supply nozzle |
| 16 | rectifying plate |
| 17 | pipeline |
| 17a | branch pipe |
| 20 | cooling system |
| 21 | chamber |
| 21a | wide portion |
| 21b | sloping portion |
| 21c | narrow portion |
| 22 | blow outlet |
| 23 | gas inlet |
| 24 | nozzle plate |
| 25 | cooling water supply nozzle |
| 26 | rectifying plate |
| 27 | pipeline |
| 30 | rail (rolled steel bar) |
| 31 | head top portion |
| 32 | head side portion |

BEST MODE FOR CARRYING OUT THE INVENTION

Specific embodiments of the present invention shall be described with reference to the appended drawings for use in understanding the present invention. Note that hereinbelow the explanation shall be given using a rail as an example of long rolled steel bar.

A cooling system that is used for cooling of rolled steel bar according to one embodiment of the present invention (hereinbelow referred to simply as a cooling system) 10 and 20 is a cooling system that cools a hot-rolled rail 30. As shown in FIG. 1, the cooling system 10 is disposed facing a head top portion 31 of the rail 30, and the cooling system 20 is disposed facing each of the head side portions 32. The distance between the cooling system 10 and the head top portion 31 of the rail 30, and the distance between the cooling system 20 and the head side portion 32 of the rail 30 are between several millimeters to several dozen millimeters mm, respectively.

The cooling system 10 has a plurality of box-shaped chambers 11 with a shape that is narrow and long in the lengthwise direction of the rail 30 (a dimension in the lengthwise direction of 1,000 mm to 5,000 mm). Since it is necessary to cool the entire length of the rail 30 simultaneously, the plurality of the chambers 11 are successively disposed in one row along the entire length of the rail 30, along the lengthwise direction of the rail 30. That is, the number of the chambers 11 is determined in accordance with the length of the rail 30. The length of each chamber 11 is for example preferably 5 m to 10 m. For that reason, in the case of the length of the rail 30 being 50 m, for example, the number of the chambers 11 that are successively disposed in one row is five to 10. Moreover, when the length of a rail 30 is 100 m, the number of the chambers 11 that are successively disposed in one row becomes 10 to 20.

The aforementioned is not meant to limit the length and number of chambers of the present invention, and in the actual manufacturing facility, the chambers are placed in an amount that covers the maximum rolled length of the rolled steel bar that is manufactured in the facility, and so the number of chambers to be operated is selected in accordance with the actual rolled length.

Hereinbelow, the chambers 11 and 21 shall be described in detail.

A gas inlet 13 that feeds air (one example of a compressed gas for cooling) that is sent out from a blower that is not illustrated is connected to the upper portion of the chamber 11 of the cooling system 10. In this box-shaped chamber 11, a cooling-water supply nozzle 15 is installed so as to supply cooling water that is supplied through a pipeline 17 in the direction of the head top portion 31 of the rail 30. A blow outlet 12 is provided in the end portion of the downstream side of the chamber 11, and it is constituted so as to push the supplied cooling water toward the blow outlet 12 by the air from the blower.

The chamber 11 is formed by a wide portion 11*a* whose width is formed wide in order to provide the gas inlet 13 at the upper portion, a narrow portion 11*c* whose width is narrower than the wide portion 11*a* and having the blow outlet 12 provided at the end portion on the downstream side, and a sloping portion 11*b* having a tapered shape that connects the wide portion 11*a* and the narrow portion 11*c*. A nozzle plate 14 that has a plurality of nozzle holes 14*c* (refer to FIG. 2) is mounted on the blow output 12 that faces the rail 30 so as to be parallel with the head top portion 31 of the rail 30. Also, in the wide portion 11*a*, a rectifying plate 16 that prevents the air that is introduced from the gas inlet 13 from directly striking the nozzle plate 14 is installed in a horizontal state between the gas inlet 13 and the cooling-water supply nozzle 15.

Meanwhile, a gas inlet 23 that introduces air that is sent out from a blower not illustrated is also connected to the chamber 21 of the cooling system 20. In the box-shaped chamber 21, a cooling water supply nozzle 25 is installed so as to supply cooling water that is supplied through a tubing 27 in the direction of the head side portion 32 of the rail 30. A blow outlet 22 is provided in the end portion of the downstream side of the chamber 21, and it is constituted so as to push the supplied cooling water toward the blow outlet 22 by the air from the blower.

The chamber 21 is formed by a wide portion 21*a* in which the width is formed wide in order to provide the gas inlet 23 at the side portion, a narrow portion 21*c* whose width is narrower than the wide portion 21*a* and having the blow outlet 12 provided at the end portion on the downstream side, and a sloping portion 21*b* having a tapered shape that connects the wide portion 21*a* and the narrow portion 21*c*. A nozzle plate 24 that has a plurality of nozzle holes is mounted on the blow output 22 that faces the rail 30 so as to be parallel with the head side portion 32 of the rail 30. Also, in the wide portion 21*a*, a rectifying plate 26 is installed between the gas inlet 23 and the cooling-water supply nozzle 25 so that the gas uniformly disperses and flows throughout the entire chamber 21.

Next, the nozzle plate 14, the cooling-water supply nozzle 15, and the rectifying plate 16 of the cooling system 10 shall be described in detail, but the nozzle plate 24, the cooling-water supply nozzle 25, and the rectifying plate 26 of the cooling system 20 are almost the same.

Figure 2:
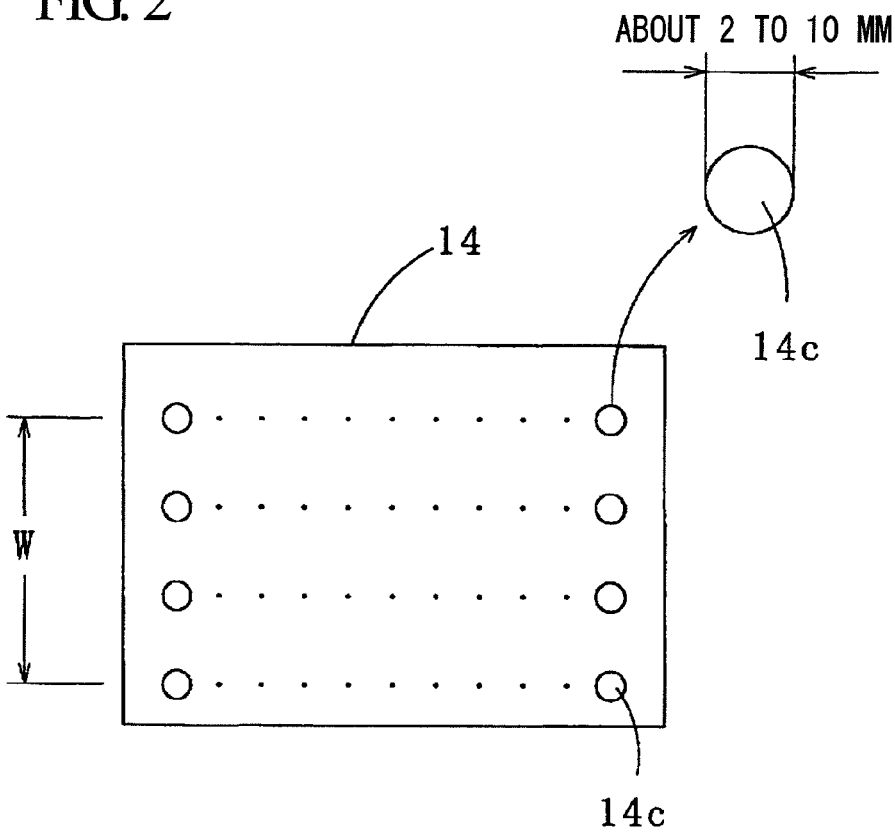
FIG. 2 is a plan view of the nozzle plate of the same cooling system.

As shown in FIG. 2, many nozzle holes 14*c* . . . having a diameter of for example 2 to 10 mm are regularly formed at a required interval (for example, an interval of 2 mm to 10 mm) in the nozzle plate 14. Also, the width W in the short direction (the width direction of the rail 30) of the region in which the nozzle holes 14*c* are formed is made to be approximately the same as the width of the head top portion 31 of the rail 30 so that the mist (cooling medium that consists of a mixture of air and cooling water) strikes over the entire width of the head top portion 31 of the rail 30 in a perpendicular manner.

Figure 3:
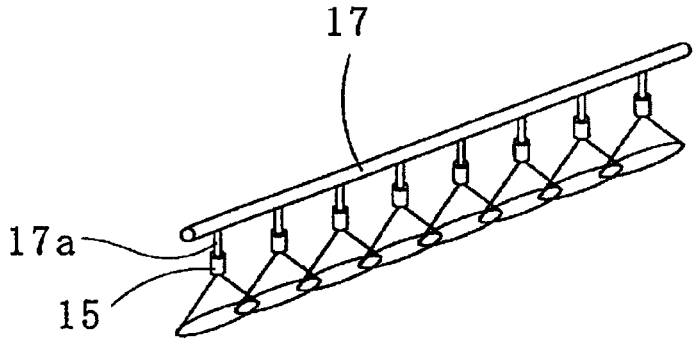
FIG. 3 is a perspective view of the pipeline and the cooling water supply nozzle that supply the cooling water.

The pipeline 17 is disposed in the chamber 11 so as to be parallel with the lengthwise direction of the rail 30, and as shown in FIG. 3, a plurality of branch pipes 17*a* . . . branch off downward from the pipeline 17. The cooling-water supply nozzle 15 is mounted on each distal end of the branch pipe 17*a*. The cooling water that is supplied from the cooling-water supply nozzle 15 may be supplied in a mist state, a shower state, or a stream state. Also, cooling water only may be supplied from the cooling-water supply nozzle 15, or a mixture of cooling water and air may be supplied from the cooling-water supply nozzle 15.

Figure 4A:
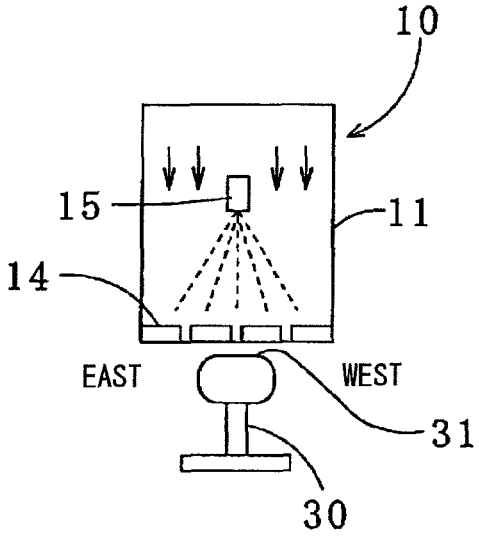
FIG. 4A is a schematic view that shows the supply state of the cooling water of the cooling water supply nozzle.
Figure 4B:
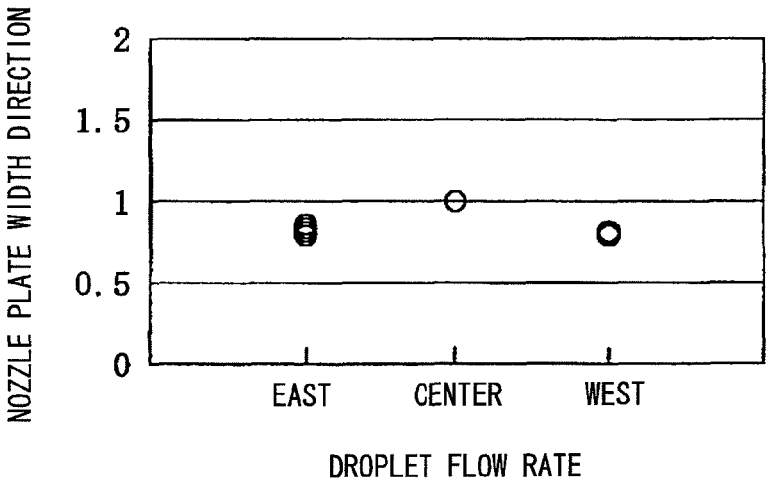
FIG. 4B is a graph that shows the relationship between the position of the cooling water supply nozzle of FIG. 4A and the droplet flow rate.

The droplet flow rate of the mist that is sprayed from the nozzle plate 14 through the nozzle holes 14*c* is made uniform so that the waterdrops that are supplied from the cooling-water supply nozzle 15 are sprayed toward the nozzle plate 14 (refer to FIG. 4A, FIG. 4B).

Figure 5:
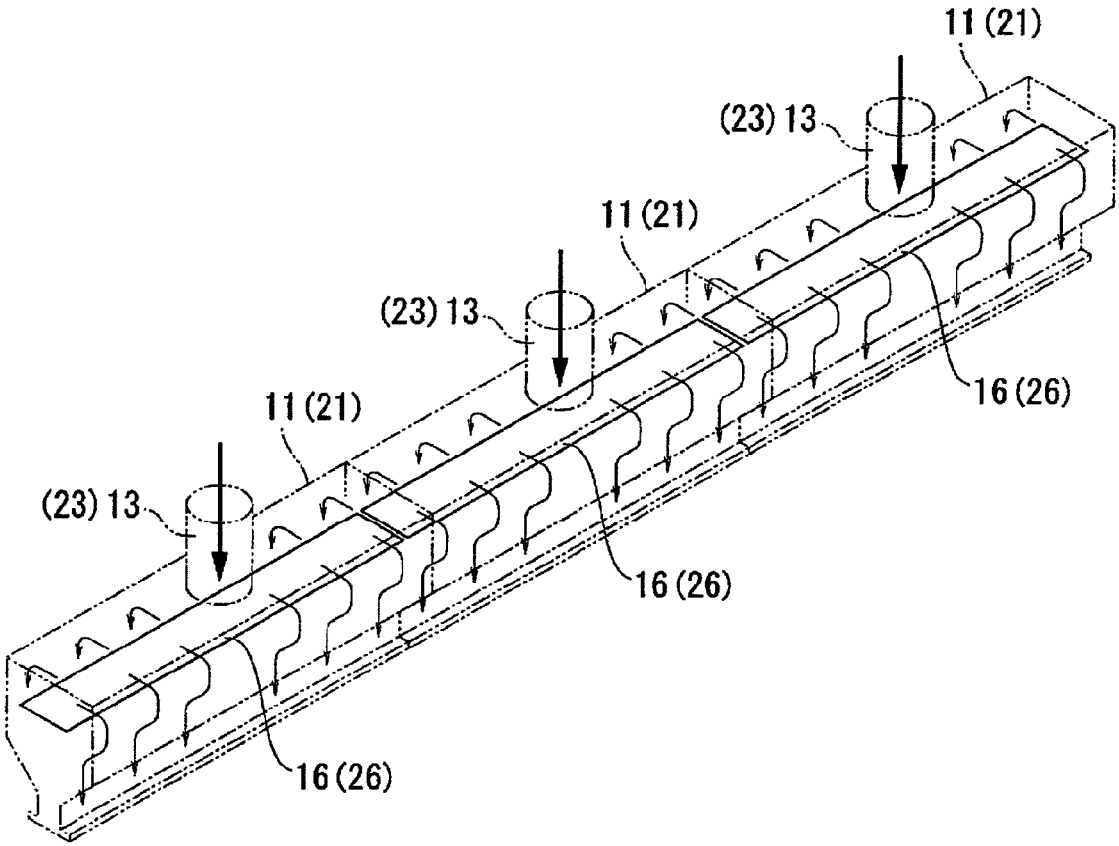
FIG. 5 is a perspective view that shows the state of the rectifying plate installed in the chamber.

The rectifying plate 16 is disposed directly below at least the corresponding portion of the gas inlet 13 of the chamber 11 when viewed from above, as shown in FIG. 5. Also, a gap is formed so that air passes between the side edges of the rectifying plate 16 and the inner walls of the wide portion 11*a*. Thereby, the air that is fed in from the gas inlet 13 disperses and flows evenly from the rectifying plate 16 throughout the entire chamber 11, and variations in the droplet flow rate distribution within the chamber 11 are prevented.

Note that, although not illustrated, many holes may be formed in the rectifying plate, and moreover when doing so, by making the total area per unit area of the holes that are formed directly below the plurality of gas inlets less than the total area per unit area of the holes that are formed in other locations, the mist that is sprayed from the nozzle plate 14 through the nozzle holes 14*c* may be made uniform in the lengthwise direction of the chamber 11.

Figure 6A:
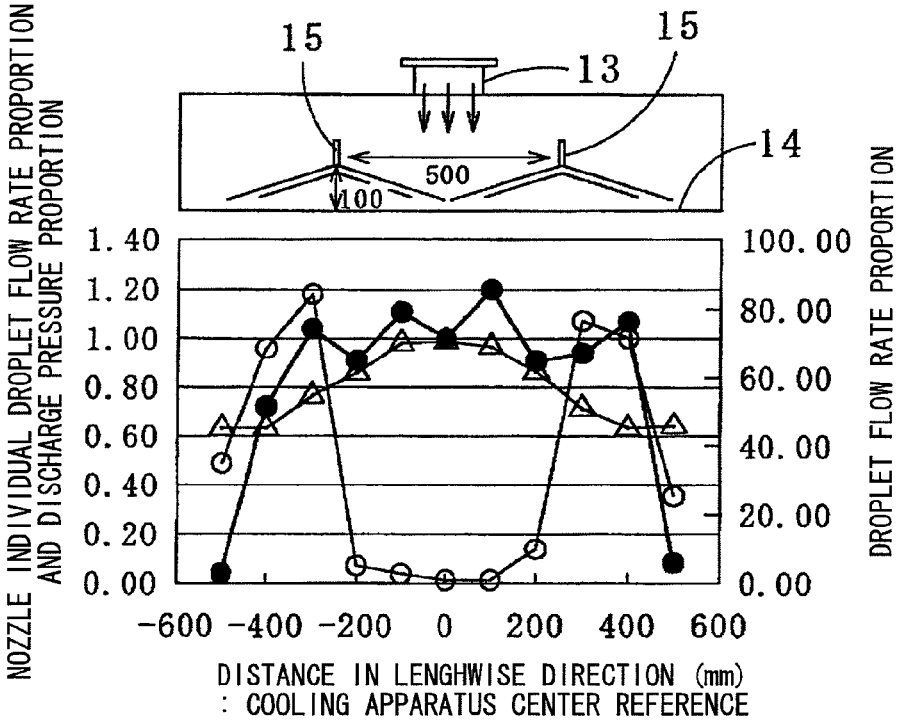
FIG. 6A is a graph that shows the discharge density of air and the droplet flow rate proportion in the state of no rectifying plate being present in the chamber.
Figure 6B:
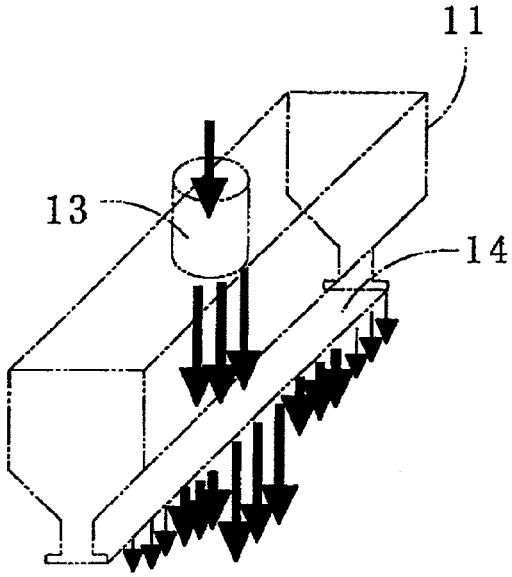
FIG. 6B is a schematic view that shows the flow of air in the chamber in the state shown in FIG. 6A.

FIG. 6A is a graph that shows the discharge distribution of air and the droplet flow rate proportion of the mist in the state of there being no rectifying plate in the chamber 11 (refer to FIG. 6B). Assuming the distance between the cooling-water supply nozzle 15 and the nozzle plate 14 is 100 mm, and the interval between adjacent cooling-water supply nozzles 15 is 500 mm, the gas inlet 13 is positioned between the cooling-water supply nozzles 15 (the distance and the interval are both test examples.)

In the case of there being no rectifying plate in the chamber 11, the air discharge amount in relation to the lengthwise direction of the chamber 11 is large directly below the gas inlet 13, and becomes small moving away from the gas inlet 13. In this state, in the case of supplying a mist from the cooling-water supply nozzle 15, since the mist is pushed by the air directly below the gas inlet 13 where the flow of air is strong, the amount of mist that is sprayed from the nozzle plate 14 through the nozzle holes 14*c* decreases. For this reason, the water content in the lengthwise direction of the chamber 11 becomes uneven.

Figure 7A:
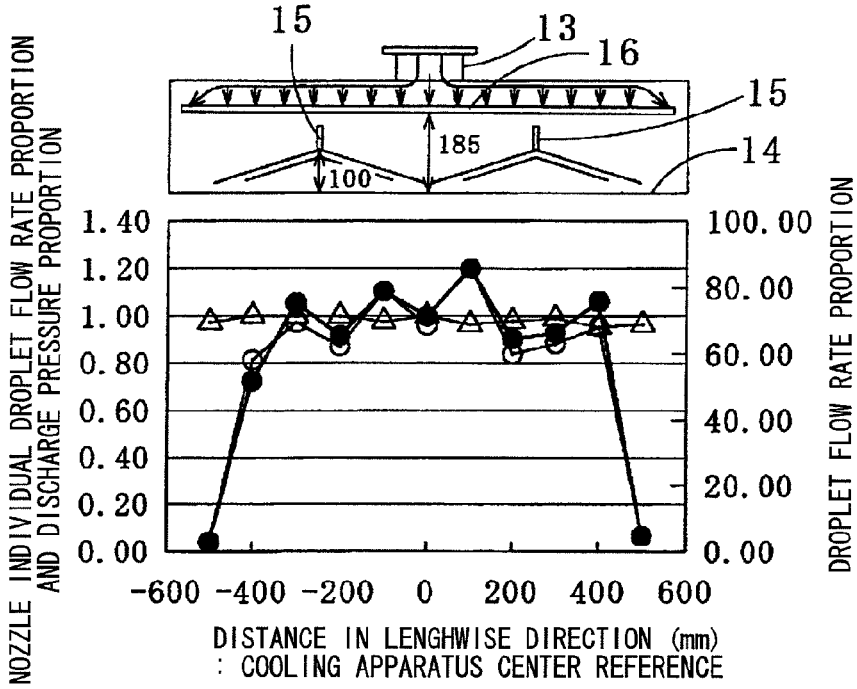
FIG. 7A is a graph that shows the discharge density of air and the droplet flow rate proportion of mist in the state of no rectifying plate being installed directly under the blower.
Figure 7B:
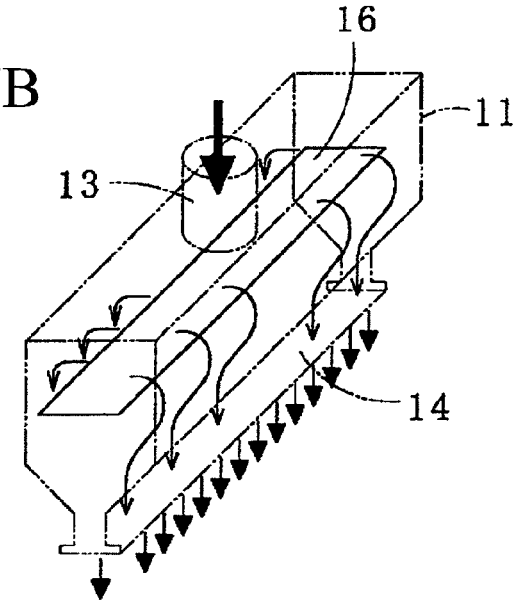
FIG. 7B is a schematic view that shows the flow of air in the chamber in the state shown in FIG. 7A.

FIG. 7A is a graph that shows the discharge distribution of air and the droplet flow rate proportion of the mist in the state of the rectifying plate 16 of a suitable shape being installed directly under the gas inlet 13 (refer to FIG. 7B). Other conditions are the same as in FIG. 6A and FIG. 6B. The distance between the rectifying plate 16 and the nozzle plate 14 is 185 mm (test example).

In the case of the rectifying plate 16 being installed directly under the gas inlet 13, since the air that is introduced from the gas inlet 13 into the chamber 11, after once colliding with the rectifying plate 16, is dispersed throughout the entire chamber 11, the discharge amount of the air that is ejected from the nozzle plate 14 through the nozzle holes 14*c* becomes uniform throughout the chamber 11.

Since the air that is introduced from the gas inlet 13 flows from the rectifying plate 16 in the lengthwise direction of the chamber 11, the water content distribution in the lengthwise direction of the chamber 11 becomes uniform.

In the case of cooling the rail head portion using the cooling system 10 and 20 having the abovementioned constitution, assuming the air-water ratio of the cooling medium that consists of a mixture of air and cooling water that is sprayed from the nozzle plates 14 and 24 is 1,000 to 50,000, and the impinging velocity of the mist on the rail head portion is 50 to 200 m/s, the cooling medium is mist sprayed from the nozzle plate 14 that is disposed facing the head top portion 31 of the rail 30 through the nozzle holes 14*c* toward the head top portion 31. Also, simultaneously with this, the cooling medium is mist sprayed from the nozzle plates 24 that are disposed facing the head side portions 32 of the rail 30 through the nozzle holes toward the head side portions 32. Then, the rail head portion is uniformly cooled from the austenite region temperature to 450 to 600° C.

The reason for defining the cooling temperature in the above manner is that if the cooling start temperature is not in the austenite region temperature or above, and the cooling end temperature is not at least 600° C. or less, it is not preferred in terms of carrying out quenching. On the other hand, when accelerated cooling is continued until below 450° C., since a martensitic structure is produced in the rail head portion, although the hardness increases, the toughness decreases, which is not preferred.

Figure 8:
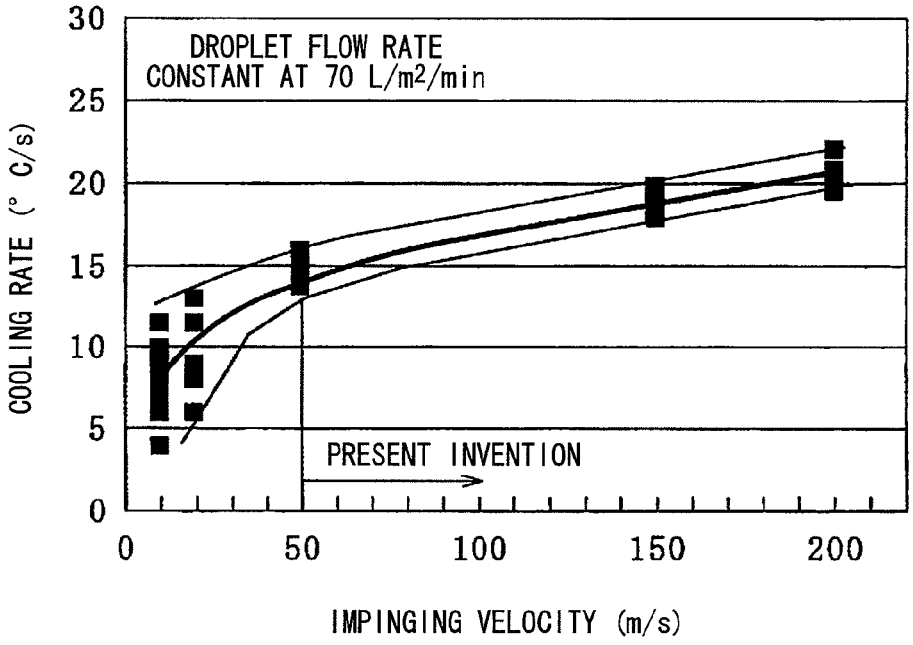
FIG. 8 is a graph that shows the relationship between the impinging velocity of mist and the cooling rate.

FIG. 8 is a graph of the relationship between the mist impinging velocity and the cooling rate, obtained by experiment.

The cooling water supply nozzle is fine mist nozzle BIMJ 2015 manufactured by H. Ikeuchi & Co., the specimen is a 141-pound rail of a length of 100 mm, and a thermocouple is embedded to a position 2 mm deep from the head top portion of the specimen.

After heating the specimen to 820° C. in a heating furnace, it is taken out of the heating furnace and cooling is started by the present cooling system from 750° C., with the cooled performed until 500° C. or less. The cooling is performed under the conditions of the discharge cooling droplet flow rate held constant at 70 liters per square meter per minute ($1/m^2/min$), and the impinging velocity of the mist set to the five conditions of 10, 20, 50, 150, and 200 m/s by changing the quantity of air. Note that the air pressure at this time was 1.1 to 1.2 atmospheres.

The mist impinging velocity Va is calculated by the following equation, denoting the discharge velocity as Ve, and distance between the blow outlet and the rail as h, and the blow outlet diameter as d.

$$Va=6.39\times Ve/(h/d+0.6)$$

The experiment was performed 10 times for each impinging velocity, and the cooling rate was found from the time required for the indicated value on the thermocouple to drop from 750° C. to 500° C. As a result, as the impinging velocity was increased, a higher cooling rate was obtained, and when the impinging velocity was 50 m/s or more, the variation in the cooling rate decreased to around ±1.5° C., and was evaluated as stable. Note that when the impinging velocity exceeds 200 m/s, it is not realistic due to the enlargement of the facility and the increased running cost.

Figure 9:
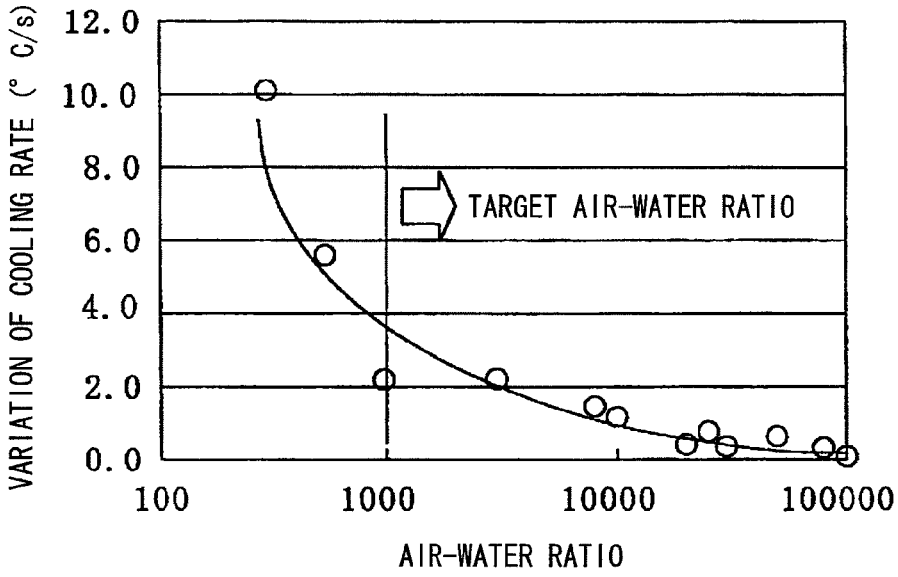
FIG. 9 is a graph that shows the relationship between the air-water ratio and variations in the cooling rate.

Also, Table 1 shows the relationship between the water-air ratio and the cooling rate. From the table, it is evident that when the air-water ratio is 1,000 or more, the standard deviation of the cooling rate is 2.2 or less, and at an air-water ratio of 50,000, that effect is saturated, and stable cooling is possible. Note that FIG. 9 is a graph of the data of Table 1.

TABLE 1

Air-Water Ratio (Gas Amount/Water Amount) and Cooling Rate

| Ratio | Cooling Rate (° C./s) | | | | | Ave | σ |
|---|---|---|---|---|---|---|---|
| 295 | 5 | 12 | 26 | 30 | 7 | 16 | 10.1 |
| 540 | 7 | 10 | 12 | 17 | 23 | 13.8 | 5.6 |
| 980 | 15 | 15 | 16 | 17 | 21 | 16.8 | 2.2 |
| 3,000 | 15 | 15 | 16 | 17 | 21 | 16.8 | 2.2 |
| 8,000 | 17 | 15 | 19 | 17 | 19 | 17.4 | 1.5 |
| 10,000 | 18 | 18 | 19 | 16 | 16 | 17.4 | 1.2 |
| 20,000 | 17.6 | 17.8 | 16.5 | 17.7 | 17.7 | 17.5 | 0.5 |
| 25,000 | 17 | 16.4 | 17.5 | 18.7 | 18.2 | 17.6 | 0.8 |
| 30,000 | 17.1 | 17.5 | 17 | 18.2 | 17.6 | 17.5 | 0.4 |
| 50,000 | 16.8 | 18.2 | 18.7 | 17.5 | 17.2 | 17.7 | 0.7 |
| 80,000 | 17.4 | 18 | 18.2 | 17.5 | 17.2 | 17.7 | 0.4 |
| 10,0000 | 17.5 | 17.6 | 17.6 | 17.8 | 17.8 | 17.7 | 0.1 |

Note that in the case of cooling the pillar portion and foot portion of a rail using the present cooling system, since the cooling rate of these sections is faster than the head portion, it is necessary to set the cooling conditions separately.

Hereinabove, the embodiment of the present invention was described, but the present invention should not be limited to the configuration described in the aforementioned embodiment, and includes other embodiments and modifications that are conceivable in the scope of the matters recited in the claims. For example, in the aforementioned embodiment, air served as the compressed gas for cooling that is introduced into the chamber, but nitrogen may also be used.

INDUSTRIAL APPLICABILITY

According to the present invention, it is possible to provide a cooling system and a cooling method for rolled steel bar that, in addition to significantly improving the cooling rate by suppressing the formation of a vapor film on the surface of long rolled steel bar, enables uniform accelerated cooling.

The invention claimed is:

1. A cooling system that cools hot rolled long steel bar, comprising a plurality of chambers that are arranged along the longitudinal direction of the rolled steel bar, the plurality of chambers each provided with:

a blow outlet that, facing from the chamber to the rolled steel bar, blows out compressed gas for cooling that is introduced to the chamber from a gas inlet that is connected to the chamber;

a cooling water supply nozzle that supplies cooling water into the chamber;

a nozzle plate that is provided at the blow outlet so as to face the rolled steel bar, and that has a plurality of nozzle holes for spraying a cooling medium that is produced by mixing the cooling water and the compressed gas for cooling; and a rectifying plate that is provided between the gas inlet and the cooling water supply nozzle so that the compressed gas for cooling that is introduced from the gas inlet disperses throughout an entire chamber, and so that a droplet flow rate distribution of the cooling medium that is sprayed toward the rolled steel bar from the nozzle plate becomes uniform along the longitudinal direction of the rolled steel bar;

wherein a gap is formed between the rectifying plate and inner walls of the chamber, and the cooling system sprays the cooling medium that is produced by mixing the cooling water that is supplied from the cooling water supply nozzle and the compressed gas for cooling that passes through the gap and disperses throughout the entire chamber toward the rolled steel bar through the nozzle holes of the nozzle plate, and thereby the surfaces of the rolled steel bar is cooled uniformly.

2. The cooling system for rolled steel bar according to claim 1, wherein the rolled steel bar is a rail, and the chambers are arranged so as to have a gap between the head top portion of this rail and the chambers, and the cooling medium is sprayed from the nozzle holes of the nozzle plate toward the head top portion of the rail.

3. The cooling system for rolled steel bar according to claim 1, wherein the rolled steel bar is a rail, and the chambers are arranged so as to have a gap between the head side portions of this rail and the chambers, and the cooling medium is sprayed from the nozzle holes of the nozzle plate toward the head side portions of the rail.

4. The cooling system for rolled steel bar according to claim 1, wherein the chamber is formed by:

a wide portion which is formed wide in order to provide the gas inlet;

a narrow portion whose width is formed narrower than the wide portion; and a sloping portion that mutually couples the wide portion and the narrow portion;

wherein the blow outlet is provided at the end portion of the narrow portion.

5. The cooling system for rolled steel bar according to claim 4, wherein:

the rolled steel bar is a rail, the chambers are disposed above the rail, and the rectifying plate is disposed in a horizontal state in the wide portion of the chamber, and the gap is formed so that the compressed gas for cooling passes between the side edges of the rectifying plate and the inner walls of the wide portion.

6. The cooling system for rolled steel bar according to any one of claims 1 to 5, wherein the ratio of the volumetric flow of the compressed gas for cooling to the volumetric flow of the cooling water is 1,000 to 50,000.

7. The cooling system for rolled steel bar according to claim 1, wherein the compressed gas for cooling is air or nitrogen.

8. The cooling system for rolled steel bar according to claim 1, wherein the cooling water is supplied from the cooling water supply nozzle in a mist state, a shower state, or a stream state.

9. The cooling system for rolled steel bar according to claim 1, wherein the rectifying plate extends to the longitudinal direction of the rolled steel bar.

10. The cooling system for rolled steel bar according to claim 1, wherein the rectifying plate is disposed directly below at least an opening of the gas inlet when viewed from the opening.

11. The cooling system for rolled steel bar according to claim 1, wherein the rectifying plate is disposed directly below at least an opening of the gas inlet when viewed from the opening, and the rectifying plate extends to the longitudinal direction of the rolled steel bar.

12. The cooling system for rolled steel bar according to claim 1, wherein the rectifying plate has a plurality of holes, and, in the plurality of holes, a total area per unit area of holes that are formed in a region directly below the gas inlet is less than a total area per unit area of holes that are formed in other regions.

13. The cooling system for rolled steel bar according to claim 1, wherein the plurality of chambers are arranged so as to cover a maximum rolled length of the rolled steel bar.

14. The cooling system for rolled steel bar according to claim 1, wherein each of the plurality of chambers has a length of 1 m to 10 m in the longitudinal direction of the rolled steel bar.

15. The cooling system for rolled steel bar according to claim 1, wherein each of the plurality of chambers has a length of 5 m to 10 m in the longitudinal direction of the rolled steel bar.

16. The cooling system for rolled steel bar according to claim 1, comprising 5 or more chambers.

17. The cooling system for rolled steel bar according to claim 1, wherein each of the plurality of chambers has a maximum length in the longitudinal direction of the rolled steel bar.

* * * * *